US008585828B2

(12) United States Patent
Joyner et al.

(10) Patent No.: US 8,585,828 B2
(45) Date of Patent: Nov. 19, 2013

(54) SYSTEMS, METHODS AND APPARATUS FOR STAIN REMOVAL

(75) Inventors: Ken Joyner, Pasedena, CA (US); Daniel Lee Bizzell, Charlotte, NC (US); Karl Christopher Gabriel, Charlotte, NC (US); Raeshon Lamont McNeil, Charlotte, NC (US); Thomas James Philpott, Charlotte, NC (US); Michael Starkey, Charlotte, NC (US); Juan Carlos Perez, Charlotte, NC (US); Ian D. Kovacevich, Carlsbad, CA (US)

(73) Assignee: Season 4, LLC, Charlotte, NC (US)

( * ) Notice: Subject to any disclaimer, the term of this patent is extended or adjusted under 35 U.S.C. 154(b) by 0 days.

(21) Appl. No.: 13/441,864

(22) Filed: Apr. 7, 2012

(65) Prior Publication Data

US 2013/0199573 A1 Aug. 8, 2013

Related U.S. Application Data

(60) Provisional application No. 61/596,218, filed on Feb. 7, 2012.

(51) Int. Cl.
*B08B 3/00* (2006.01)

(52) U.S. Cl.
USPC ..... 134/21; 134/34

(58) Field of Classification Search
CPC ..... A47L 5/00; A47L 5/34; B05B 11/02; F04B 19/06; F04B 19/14; F04B 19/109
USPC ..... 134/184, 21, 34, 195–197; 15/320, 346, 15/353; 433/81
See application file for complete search history.

(56) References Cited

U.S. PATENT DOCUMENTS

| | | | | | |
|---|---|---|---|---|---|
| 3,939,527 | A * | 2/1976 | Jones | 15/353 |
| 4,123,818 | A * | 11/1978 | Hurwitz | 15/321 |
| 4,262,669 | A * | 4/1981 | Sneider | 604/200 |
| 4,306,558 | A * | 12/1981 | Kurtz et al. | 604/73 |
| 5,201,719 | A * | 4/1993 | Collins et al. | 604/195 |
| 5,343,592 | A * | 9/1994 | Parise | 15/353 |
| 2006/0008356 | A1 * | 1/2006 | Smith et al. | 417/182 |
| 2006/0207052 | A1 * | 9/2006 | Tran | 15/320 |
| 2008/0160479 | A1 * | 7/2008 | Ruddle et al. | 433/81 |
| 2008/0160480 | A1 * | 7/2008 | Ruddle et al. | 433/81 |
| 2008/0277413 | A1 * | 11/2008 | Jablonski et al. | 222/79 |
| 2008/0308177 | A1 * | 12/2008 | Thuot et al. | 141/65 |

* cited by examiner

*Primary Examiner* — Michael Kornakov
*Assistant Examiner* — Marc Lorenzi
(74) *Attorney, Agent, or Firm* — Tillman Wright, PLLC; Chad D. Tillman

(57) ABSTRACT

A hand carried, manually operated apparatus for cleaning flooring, carpet, upholstery, and the like includes a cleansing fluid chamber, a waste fluid chamber, a pump and an applicator. A first fluid passageway connects the pump and cleansing fluid chamber, a second passageway connects the cleansing fluid chamber and applicator, a third passageway connects the applicator and waste fluid chamber, and a fourth passageway connects the waste fluid chamber and pump. A first one-way valve permits flow from the pump to the cleansing fluid chamber but inhibits reverse flow; and a second one-way valve permits flow from the applicator to the waste fluid chamber but inhibits reverse flow. Air is transferred through the pump from the waste fluid chamber to the cleansing fluid chamber as cleansing fluid is transferred to the applicator from the cleansing fluid chamber and waste fluid is transferred from the applicator to the waste fluid chamber.

20 Claims, 13 Drawing Sheets

SYSTEMS, METHODS AND APPARATUS FOR STAIN REMOVAL

CROSS-REFERENCE TO RELATED APPLICATION

The present application is a nonprovisional patent application of, and claims priority under 35 U.S.C. §119(e) to, U.S. provisional patent application Ser. No. 61/596,218, filed Feb. 7, 2012, which '218 application is incorporated herein by reference. Furthermore, the appendix hereto includes the disclosure of the '218 application, which disclosure of the appendix is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND

The present invention generally relates to systems, methods and apparatus for removing stains and spills from carpet, upholstery and the like, although some aspects and features of the present invention are not limited to use in such fields and will find broader application, as will be apparent from the following disclosure.

Electric carpet cleaning machines, including shampooing machines and carpet steamers, are well known. However, such machines can be heavy and cumbersome to move and manipulate. Such machines are also inconvenient to use when a small spill or stain needs to be lifted or cleaned, as opposed to cleaning a room or larger area. Handheld electric or battery operated devices are also known, which include scrubbers and sprayers as well as suctioning for cleaning and lifting spills and stains. Nonetheless, it is believed that there is room for improvement over such devices and machines. One or more aspects or features of the invention are intended to address such need.

SUMMARY

The present invention generally relates to systems, methods and apparatus for removing stains and spills from carpet, upholstery and the like, although some aspects and features of the present invention are not limited to use in such fields and will find broader application, as will be apparent from the following disclosure. Indeed, while the present invention is described in detail with regard to the cleaning of spots and spills on a carpet, the present invention is also applicable to the cleaning of other types of flooring as well as upholster, furniture, and the like, as will be apparent to the Ordinary Artisan.

Accordingly, in an aspect, an apparatus for cleaning an area comprises: a pump; a cleansing fluid chamber, wherein a first fluid passageway connects the pump and the cleansing fluid chamber; an applicator, wherein a second fluid passageway connects the cleansing fluid chamber and the applicator; a waste fluid chamber, wherein a third fluid passageway connects the applicator and the waste fluid chamber and a fourth fluid passageway connects the waste fluid chamber and the pump; a first one-way valve configured to permit flow through the first fluid passageway in a flow direction from the pump to the cleansing fluid chamber but inhibit flow through the first fluid passageway in a flow direction from the cleaning fluid chamber to the pump; and a second one-way valve configured to permit flow through the third fluid passageway in a flow direction from the applicator to the waste fluid chamber but inhibit flow through the first fluid passageway in a flow direction from the waste fluid chamber to the applicator.

In a feature, the apparatus further includes a cleansing fluid in the cleansing fluid chamber and air in the waste fluid chamber, and wherein the apparatus is configured such that air is transferred through the pump from the waste fluid chamber to the cleansing fluid chamber as cleansing fluid is transferred to the applicator from the cleansing fluid chamber and waste fluid is transferred from the applicator to the waste fluid chamber. The standing pipes may be disposed in parallel relation to each other and to the cylinder in which the piston moves.

In a feature, the pump is manually operated.

In a feature, the pump comprises a handle, piston and cylinder, and the pump is manually operated by gripping the handle and moving the piston repeatedly back and forth within the cylinder.

In a feature, movement of the piston within the cylinder results in the pumping of air into the cleansing fluid chamber regardless of the direction of movement of the piston within the cylinder of the pump.

In a feature, the pump comprises: a piston; a cylinder in which the piston is located, movement of the piston within the cylinder changing the volume of space in first and second piston areas on respective sides of the piston; an incoming chamber in fluid communication with the fourth fluid passageway; an outgoing chamber in fluid communication with the first fluid passageway; first and second one-way valves, the first one-way valve configured to permit flow from the incoming chamber to the first piston area and the second one-way valve configured to permit flow from the incoming chamber to the second piston area; and third and fourth one-way valves, the third one-way valve configured to permit flow to the outgoing chamber from the first piston area and the fourth one-way valve configured to permit flow to the outgoing chamber from the second piston area. Additionally, the pump further may comprise a standing pipe through which air flows into the first piston area and another standing pipe through which air flows from the first piston area; the apparatus further may comprise a first standing pipe in the cleansing fluid chamber through which air flows into the cleansing fluid chamber, a second standing pipe in the waste fluid chamber through which liquid flows into the waste fluid chamber; and a third standing pipe in the waste fluid chamber through which air flows out of the waste fluid chamber; and all of said standing pipes may be arranged in parallel relation to each other.

In another feature, the applicator defines a recessed area at which the area to be cleaned is covered.

In a feature, the applicator comprises a fluid distribution component through which cleansing fluid is conveyed from the second fluid passageway to the area to be cleaned.

In a feature, the applicator comprises a fluid suction port through which fluid is suctioned from the area to be cleaned, the fluid suction port in fluid communication with the third fluid passageway.

In a feature, the applicator comprises a central fluid suction port in fluid communication with the third fluid passageway through which fluid is suctioned from the area to be cleaned, and a plurality of openings arranged about the fluid suction port in fluid communication with the second fluid passageway through which cleansing fluid is applied to the area to be cleaned.

In a feature, an interior of the cleaning fluid chamber is visible from an exterior of the apparatus, whereby the extent to which the cleaning fluid has been used is visible by a person using the apparatus.

In a feature, an interior of the waste fluid chamber is visible from an exterior of the apparatus, whereby the extent to which the waste fluid chamber has been filled is visible by a person using the apparatus.

In a feature, the apparatus is hand portable.

In a feature, the applicator is located on a bottom side of the apparatus such that the apparatus is configured to be positioned over the area to be cleaned.

In another aspect, a method of cleaning an area with a manually operated, hand carried cleaning apparatus includes the steps of: filling a cleaning fluid chamber of the cleaning apparatus with a cleaning fluid; positioning the apparatus over the area to be cleaned and pressing the cleaning apparatus such that the cleaning apparatus encompasses the area and creates at least a partial seal surrounding the area; while so pressing the apparatus, manually actuating a pump of the apparatus such that air from a waste fluid chamber of the cleaning apparatus is pumped into a cleaning fluid chamber of the cleaning apparatus and, commensurate therewith, suctioning waste fluid from the area while applying cleaning fluid from the cleaning fluid chamber to the area, the waste fluid suctioned from the area being received and retained within the waste fluid chamber.

The method further includes, in a feature thereof, the steps of removing the cleaning apparatus from the area and emptying the waste fluid from the waste fluid chamber by pouring the waste fluid from the chamber.

DETAILED DESCRIPTION

Figure 1:
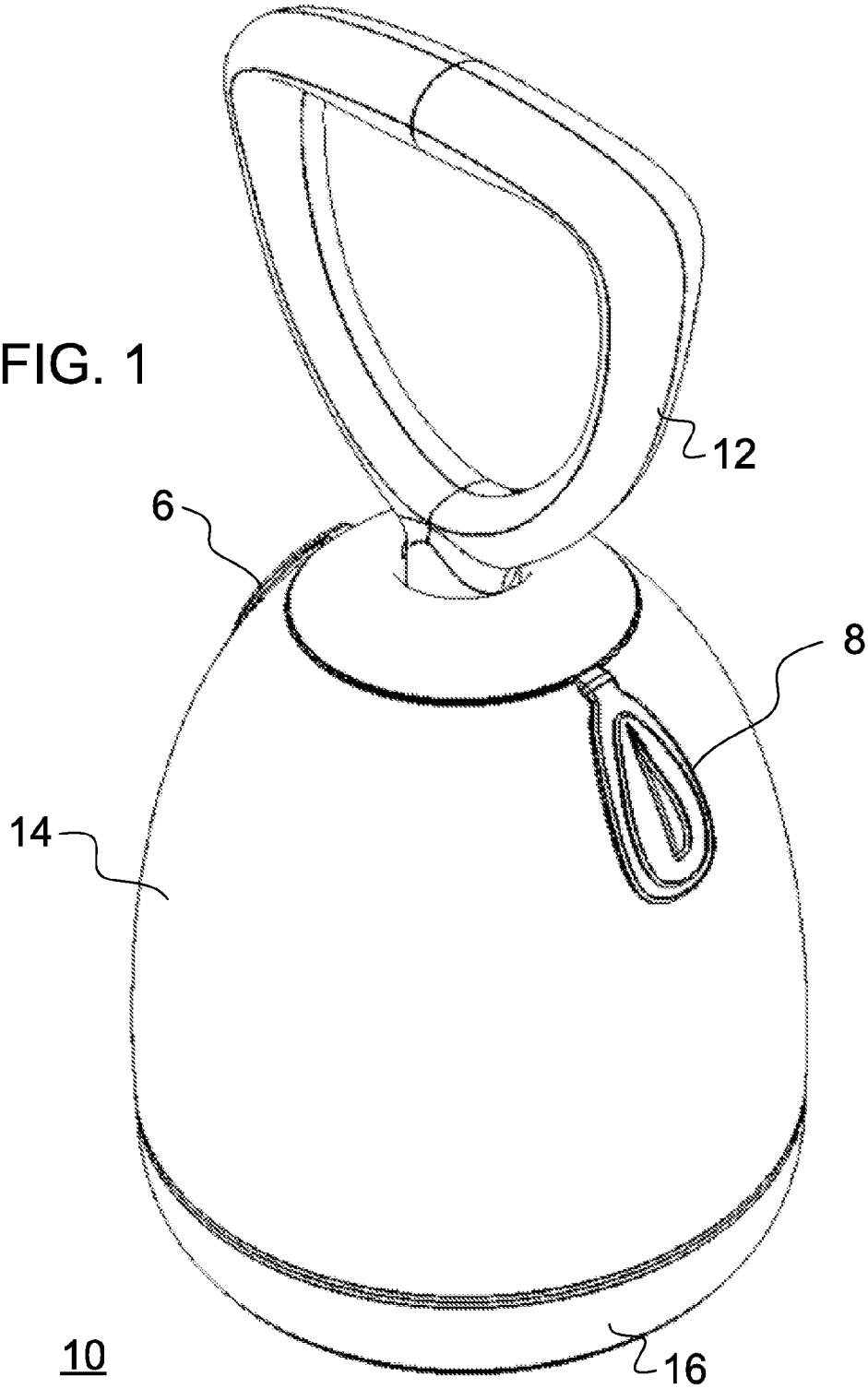
FIG. 1 is a perspective view of a preferred cleaning apparatus for lifting, removing and extracting a spill or stain in accordance with one or more aspects and features of the present invention.
Figure 2:
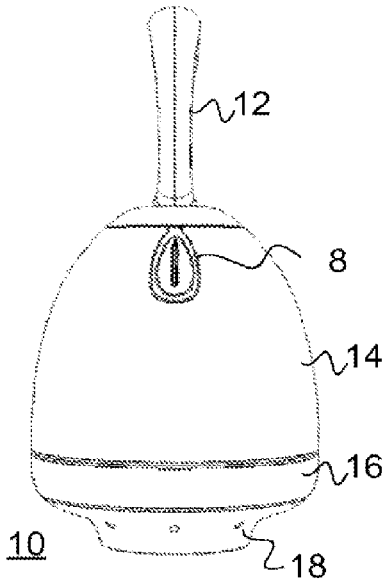
FIG. 2 is a perspective view of a side of the cleaning apparatus of FIG. 1.
Figure 3:
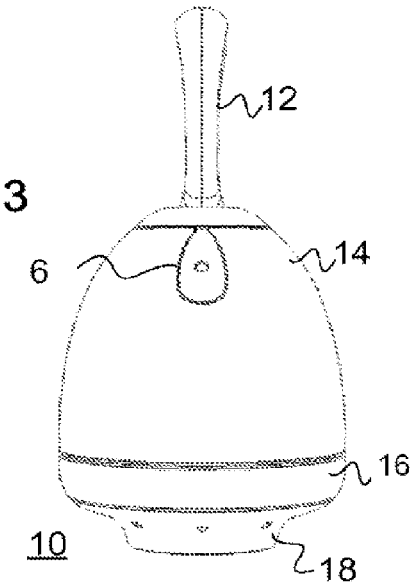
FIG. 3 is a perspective view of the opposite side of the cleaning apparatus of FIG. 1.
Figure 4:
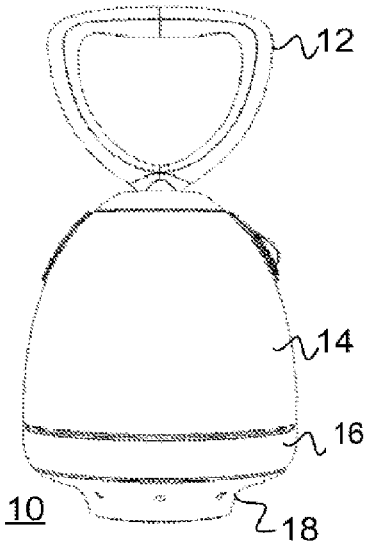
FIG. 4 is a perspective view of a front of the cleaning apparatus of FIG. 1.
Figure 5:
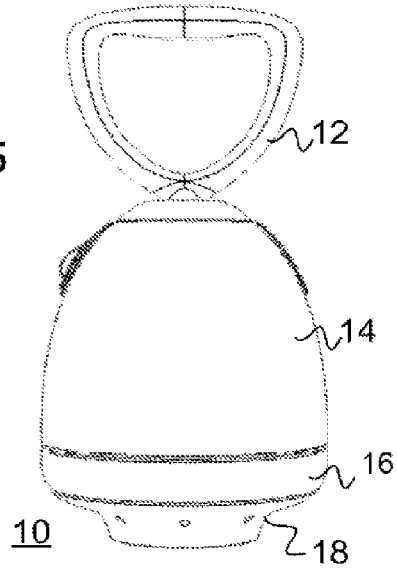
FIG. 5 is a perspective view of a back of the cleaning apparatus of FIG. 1.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 6:
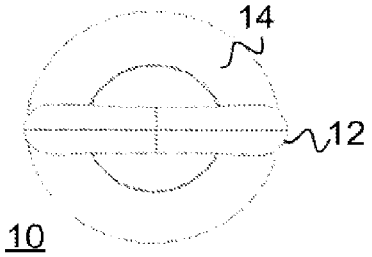
FIG. 6 is a plan view of a top of the cleaning apparatus of FIG. 1.
Figure 7:
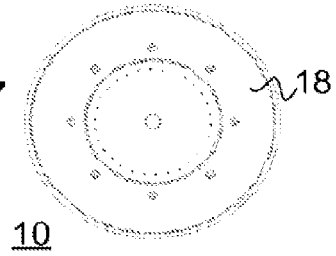
FIG. 7 is a plan view of a bottom of the cleaning apparatus of FIG. 1.

In particular, a preferred cleaning apparatus 10 for lifting, removing and extracting a spill or stain in accordance with one or more aspects and features of the present invention is shown in FIG. 1. FIGS. 2-5 are side elevational views of apparatus 10, FIG. 6 is a plan view of a top of apparatus 10, and FIG. 7 is a plan view of a bottom of the apparatus 10. A similar apparatus 20 having transparent outer wall 14' is shown in FIG. 8, and the follow description of apparatus 10 is equally applicable to apparatus 20.

Cleaning apparatus 10 is hand transportable and hand operable, and includes a handle 12; an outer wall 14; a base 16; and an applicator 18.

Figure 8:
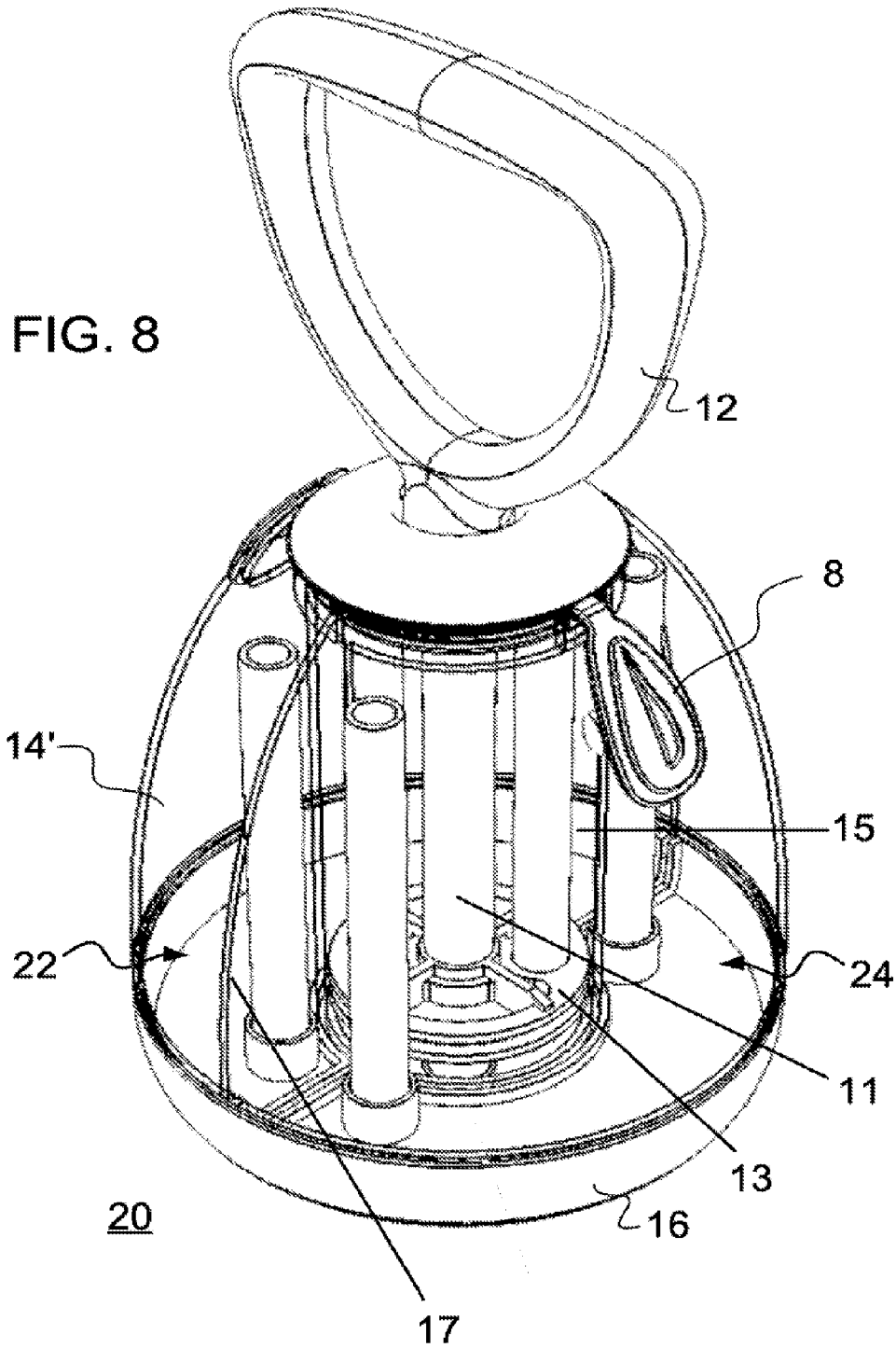
FIG. 8 is a perspective view of a preferred cleaning apparatus for lifting, removing and extracting a spill or stain in accordance with one or more aspects and features of the present invention, which is the same as that of FIG. 1 except that it includes a transparent outer wall through which the interior of the cleaning fluid chamber and waster fluid chamber are visible.

As shown in FIG. 8, the handle 12 is attached to a piston 11 and includes a head 13. The piston 11 and head 13 are disposed within cylinder 15. The piston head 13 is disk-shaped and creates an airtight seal with the interior wall of the cylinder 15 against which it moves, and against standing pipes 36,38 of the pump, which are described in greater detail below. In this respect, the head 13 defines openings through which the standing pipes 36,38 extend during movement of the head 13 within the cylinder 15. Movement of the handle 12 up and down relative to the outer wall 14 and base 16 causes the head 13 of the piston 11 to move back and forth within the cylinder 15 and displace the air within the cylinder 15. The handle 12; piston 11; cylinder 15; and standing pipes 36,38 all form part of a manually operated pump, the operation of which is described in greater detail below.

The outer wall 14 of the apparatus 10 defines, in part, the outer walls of two interior chambers, including a cleansing fluid chamber 22, and a waste fluid chamber 24, which are perhaps best seen in FIG. 8 with reference to apparatus 20. An interior wall 17 of the apparatus defines the interior walls of the respective chambers 22,24. The interior wall 17 also defines the cylinder 15 within which the piston 11 moves and head 13 resides.

Each chamber includes an opening through which liquid is poured. With respect to the cleansing fluid chamber 22, a cap 6 covers the opening; and with respect to waste fluid chamber 24, a cap 8 covers that opening. A cleaning fluid to be used to cleanse an area is poured through the opening into the cleansing fluid chamber 22 in preparation for cleaning, and waste fluid suctioned from the area is poured from the waste fluid chamber 24 after cleaning. In the apparatus 10, the interior wall 17 generally divides the apparatus in half and separates the cleansing fluid from any waste fluid in the respective chambers 22,24.

Figure 19:
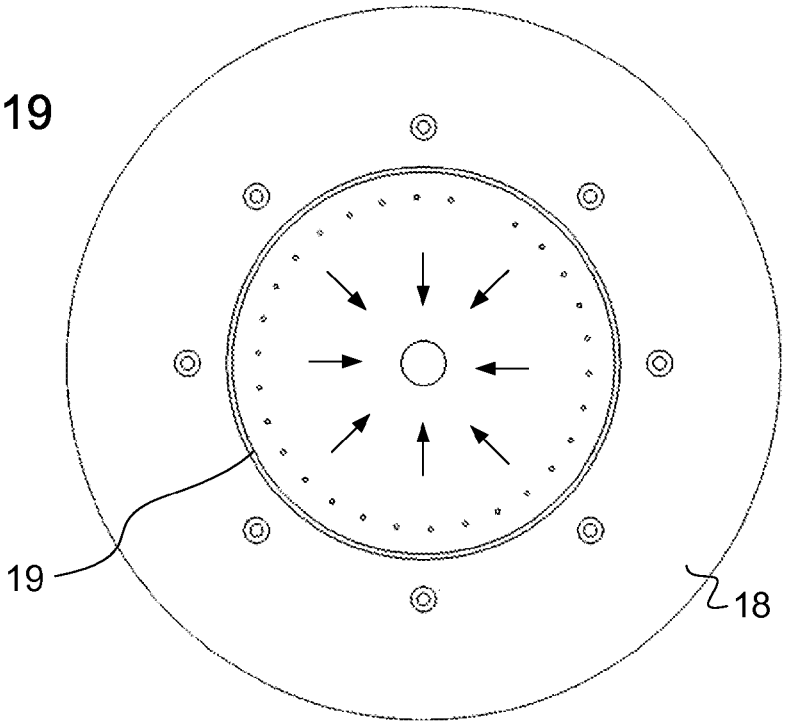
FIG. 19 is a bottom plan view of the combination of the base, applicator body, and applicator distribution plate.

The applicator 18 is located on the bottom of the apparatus 10, and is used to cover an area to be cleaned. Specifically, when the apparatus 10 is positioned over the area to be cleaned and the apparatus 10 is pressed, the applicator 18 encompasses the area and creates at least a partial seal surrounding the area by engagement of a rim 19 of the applicator 18 with a surrounding perimeter of the area. The rim 19 is perhaps best seen in FIGS. 11, 13 and 19.

Figure 9:
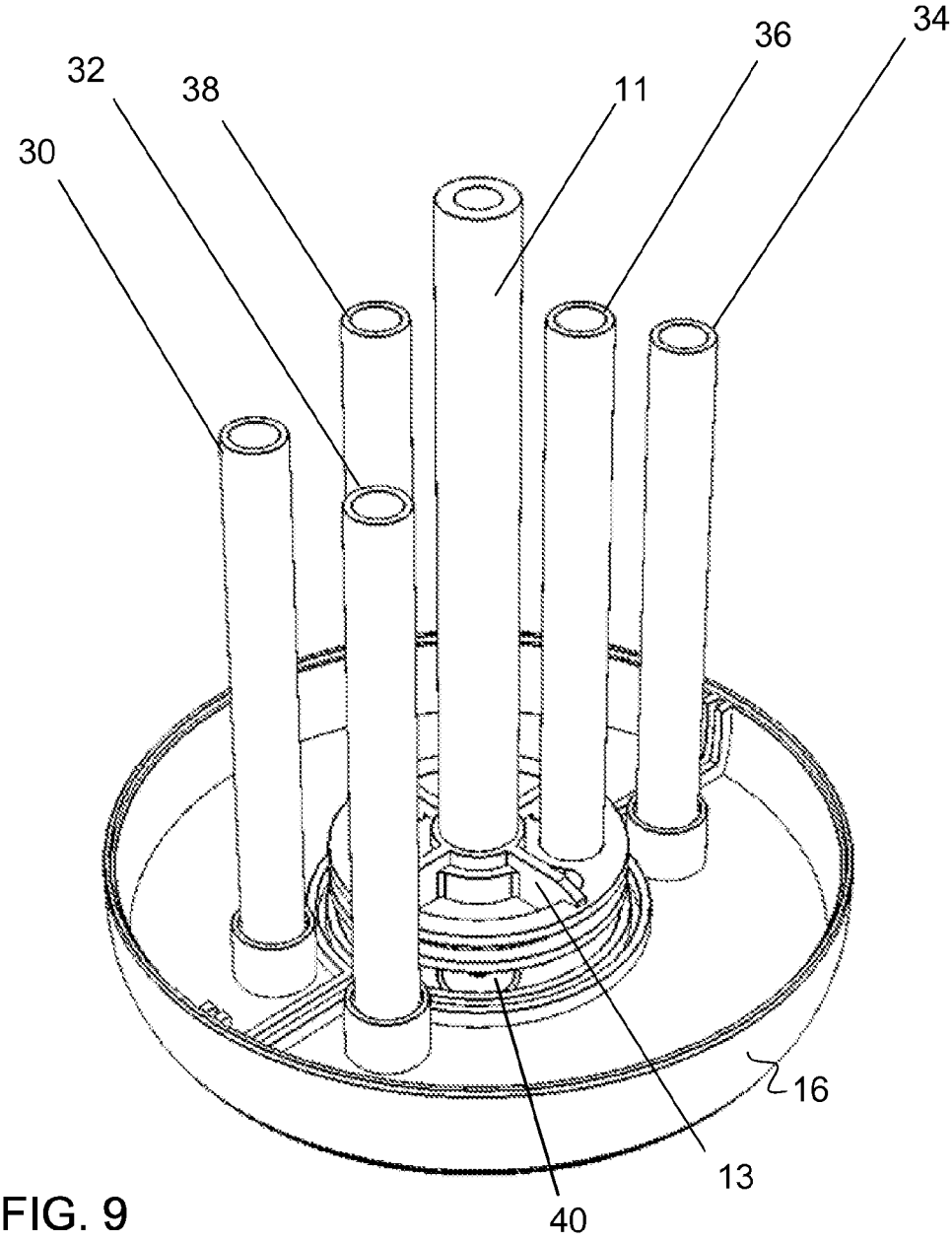
FIG. 9 is a perspective view of various components of the preferred cleaning apparatus of FIG. 1, including base, cylinder, and standing pipes.

FIG. 9 is a perspective view of various components of cleaning apparatus 10, including base 16, piston 11 and head 13, and standing pipes 30,32,34,36,38. Air flows through standing pipe 30 into the cleansing fluid chamber 22; waste fluid suctioned from an area being cleaned flows through standing pipe 32 into waste fluid chamber 24; and air flows from waste fluid chamber 24 through standing pipe 34. Part of the air from the waste fluid chamber 24 travels to one area of the pump through standing pipe 36, and then travels from that side through standing pipe 38. The standing pipes 30,32,34, 36,38 are in parallel relation to each other and to the cylinder 15 in which the piston head 113 moves. One-way valve 40 is also visible in part in FIG. 9, through which the other part of the air from the waste fluid chamber 24 travels to the other area of the pump.

Figure 10:
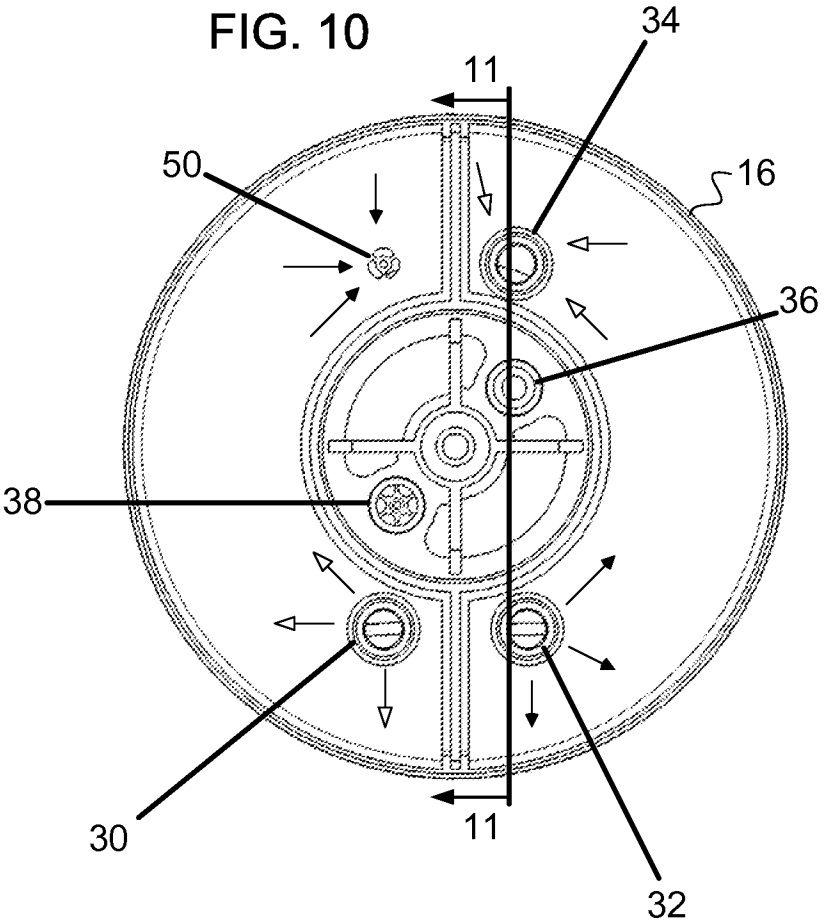
FIG. 10 is a plan view of components of FIG. 9.
Figure 12:
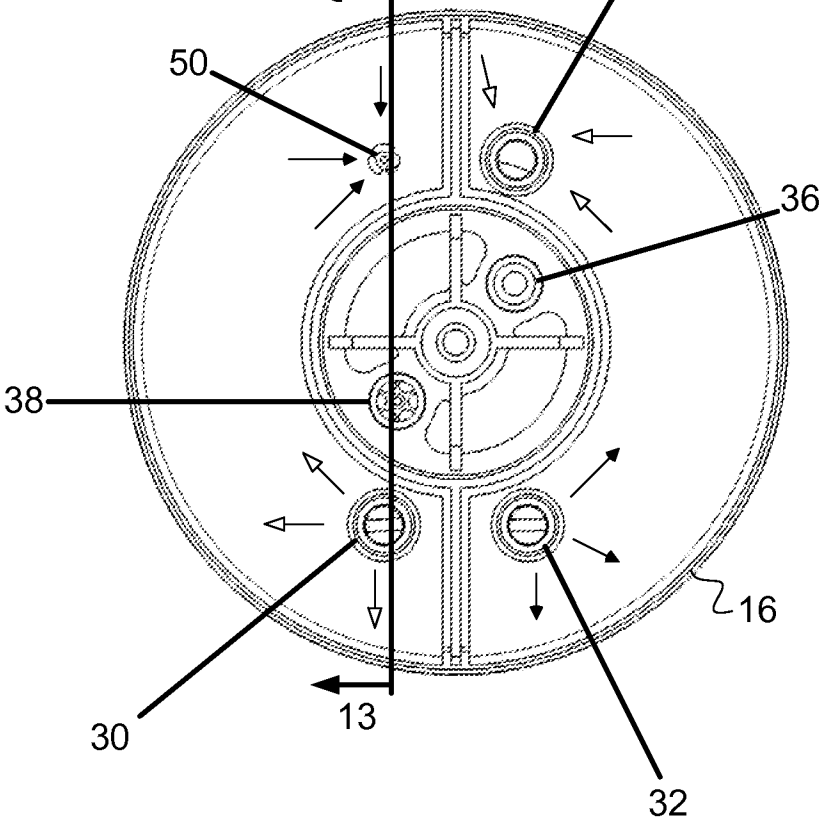
FIG. 12 is the plan view of FIG. 10.

FIG. 10 is a plan view of components of FIG. 9. Solid arrows indicate flow of fluid and, in particular, flow of waste fluid through standing pipe 32 into waste fluid chamber 24, and flow of cleansing fluid from cleansing fluid chamber 22 through opening 50 defined in the base 16 for travel to applicator 18. Open arrows indicate the flow of air and, in particular, flow of air from the waste fluid chamber 22 into and down standing pipe 34 toward the pump, and flow of air from the pump up through standing pipe 30 into the cleansing fluid chamber 22. FIG. 12 is the same view as FIG. 10.

Figure 11:
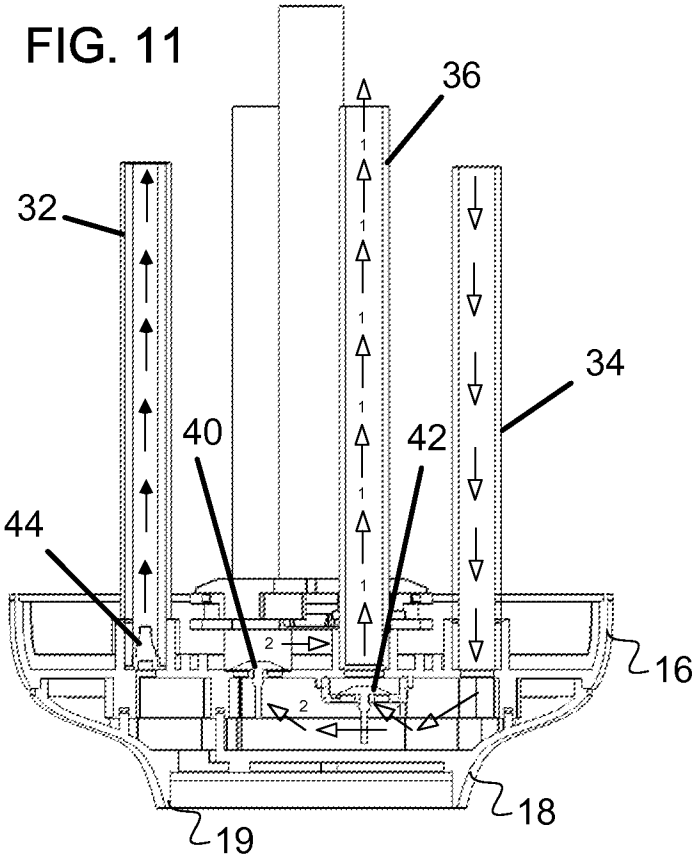
FIG. 11 is a cross-sectional view of the components of FIG. 10 taken along the line 11-11.

FIG. 11 is a cross-sectional view of the components of FIG. 10 taken along the line 11-11. The split of air flow through the pump is perhaps best seen in FIG. 11 taken in conjunction with FIG. 13. The complete flow of air from the waste fluid chamber 24 travels through standing pipe 34 and take either one of two paths depending on the direction of travel of the piston 11 within the cylinder 15. When the piston is traveling upwardly (due to the handle 12 being pulled away from the base 16), air flows through umbrella valve 42 up through standing pipe 36 into a first piston area. This path is indicated by open arrows shown adjacent the numeral '1'. On the other hand, when the piston is traveling downwardly (due to the handle 12 being pushed toward the base 16), air flows through umbrella valve 40 into a second piston area. This path is indicated by open arrows shown adjacent the numeral '2'.

FIG. 11 also shows waste fluid flow away from the applicator 18, through standing pipe 32, into waste fluid chamber 24. A one-way valve 44 is provided in order to inhibit reverse flow of the waste fluid back toward applicator 18, which would be undesirable.

Figure 13:
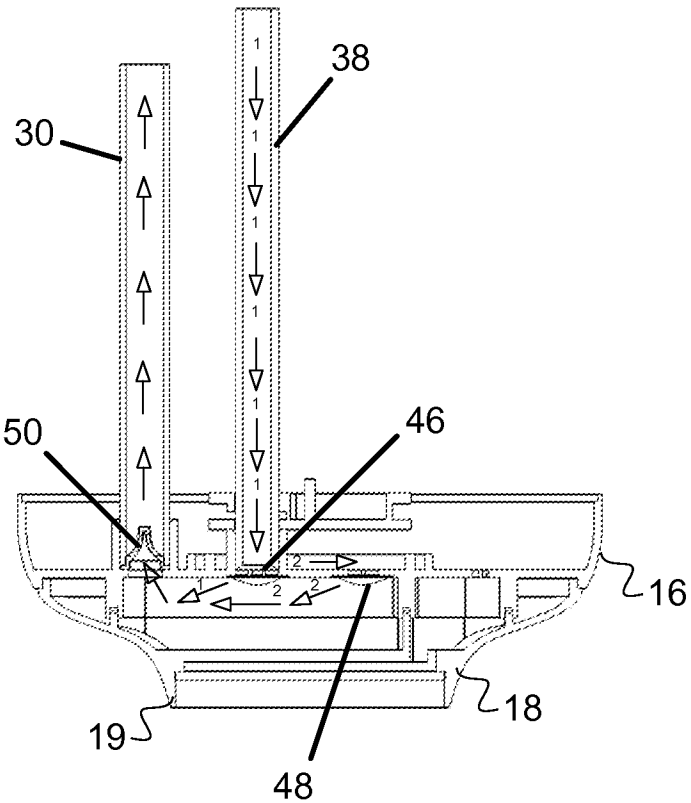
FIG. 13 is a cross-sectional view of the components of FIG. 12 taken along the line 13-13.

FIG. 13 is a cross-sectional view of the components of FIG. 12 taken along the line 13-13. The split air flow path through the pump, discussed above, is recombined on the other side of the pump as shown in FIG. 13. In particular, the air from the first piston area travels down standing pipe 38 and through umbrella valve 46, whereat air flow from the second piston area also travels through umbrella valve 48. Air flow from both of the one-way valves 46,48 then travels through one-way valve 50 and travels up through standing pipe 30 into the cleansing fluid chamber 22. The air flow path from the first piston area is indicated by open arrows shown adjacent the numeral '1', and the air flow path from the second piston area is indicated by open arrows shown adjacent the numeral '2'.

The piston areas are located on opposite sides of the piston head. As will be appreciated, movement of the piston head within the cylinder changes the volume of space in the first and second piston areas, wherein one increases as the other decreases, and vice-versa. This results in air being drawn into one of the piston areas concurrently with air being expelled from the other of the piston areas, and provide a dual-action pump whereby continuous pumping of air is provided during both forward and back (or up and down) strokes of the piston.

Figure 14:
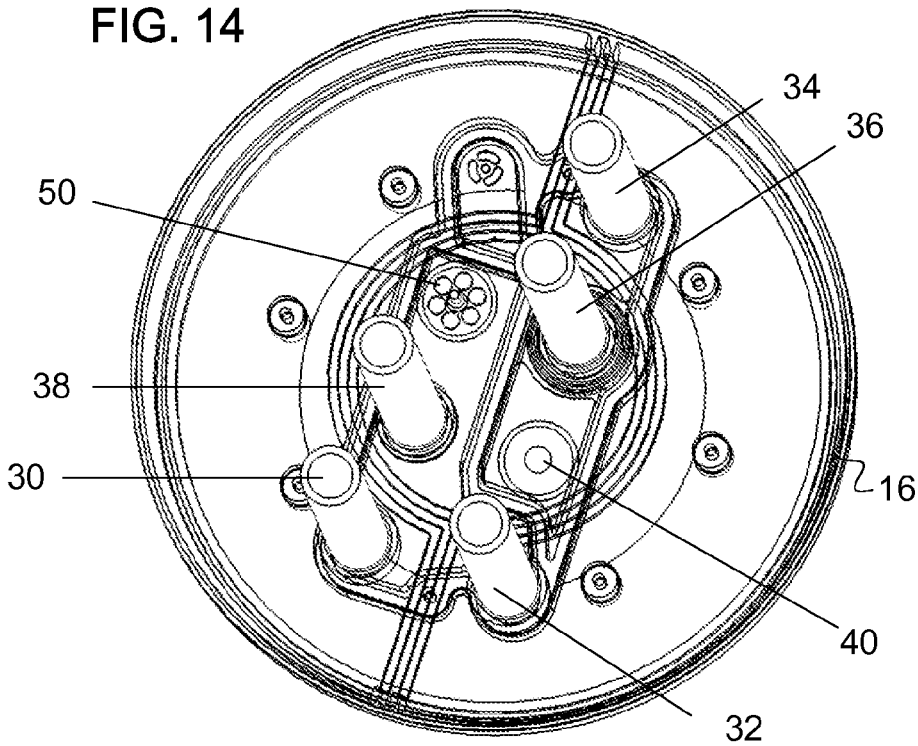
FIG. 14. is a perspective, schematic view of components of the preferred cleaning apparatus of FIG. 1.
Figure 15:
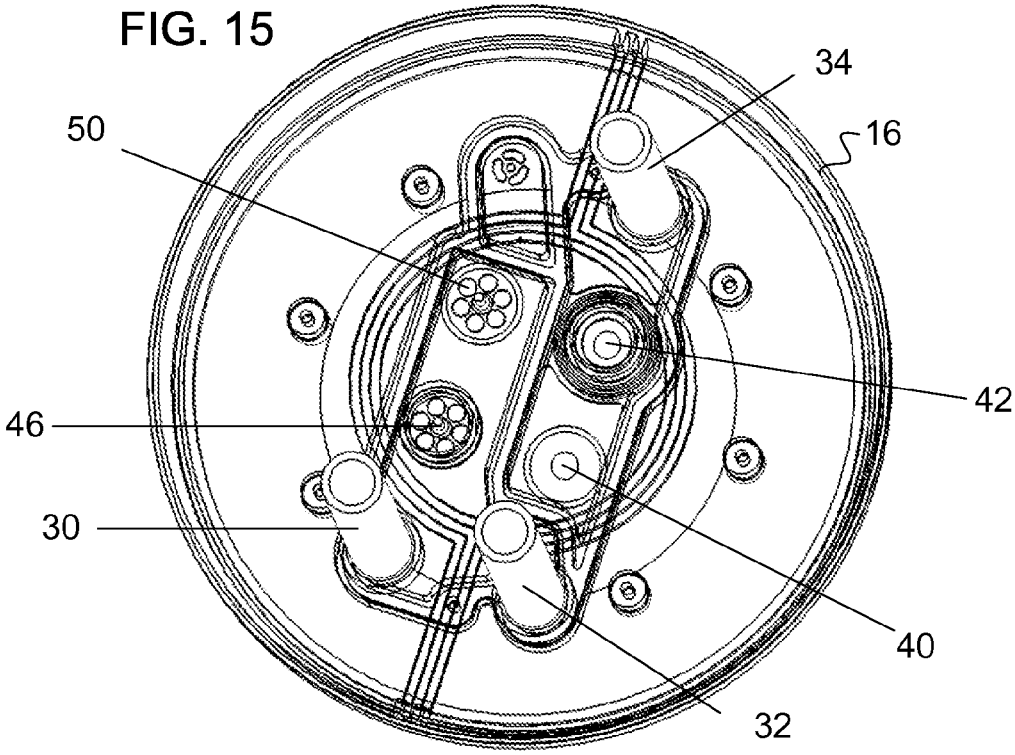
FIG. 15. is another perspective, schematic view of components of the preferred cleaning apparatus of FIG. 1.
Figure 16:
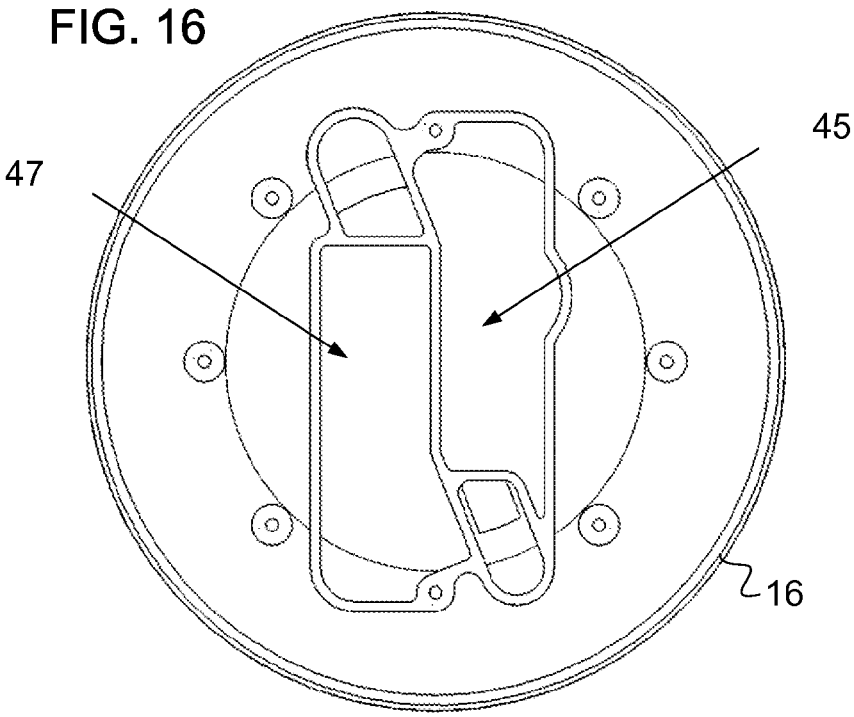
FIG. 16 is a bottom plan view of a base component of the preferred cleaning apparatus of FIG. 1.
Figure 17:
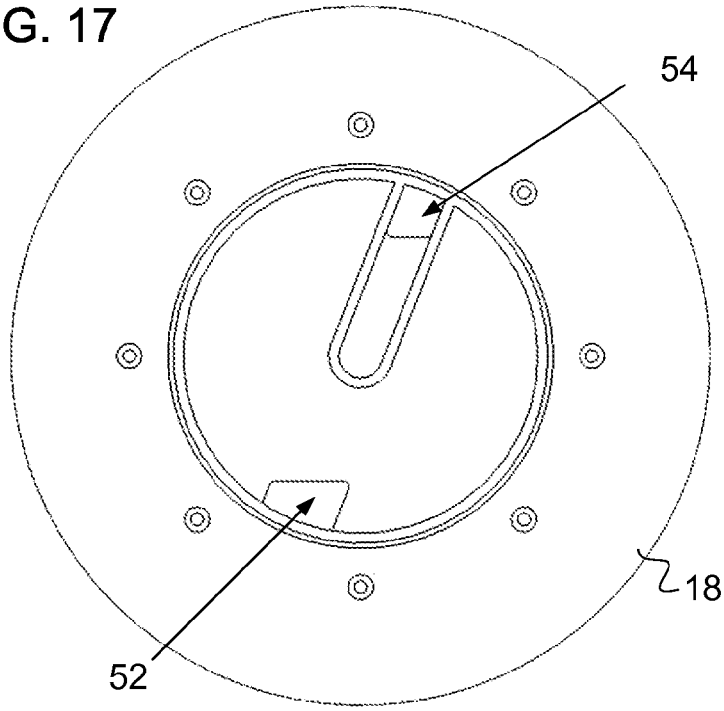
FIG. 17 is a bottom plan view of an applicator body component of the preferred cleaning apparatus of FIG. 1.

FIGS. 14 and 15 further illustrate the standing pipes and one-way valves, and further schematically illustrate the defines recesses and resulting intermediate compartments that are defined thereby on the underside of the base 16 when the base 16 and applicator 18 are attached. Further in this respect, FIG. 17 shows the recessed spaces defined on the bottom of the base. The top of the applicator 18 includes corresponding walls for engaging the base when the two components are secured together. The intermediate compartments include the locations at which the air flow is split and then later recombined, as discussed above. Specifically, the space 45 shown in FIG. 16 forms the compartment in which the airflow is split, and the space 47 shown in FIG. 16 forms the compartment where the airflow is recombined.

Figure 18:
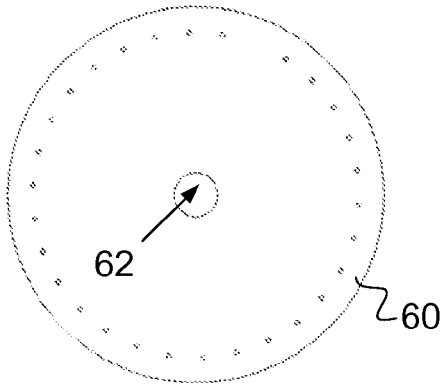
FIG. 18 is a bottom plan view of an applicator distribution component of the preferred cleaning apparatus of FIG. 1.

FIG. 17 shows a bottom of the applicator body, which includes two openings 52,54. Cleansing fluid for applying to the area to be cleaned travels through opening 52 onto a distribution plate 60, and waste fluid suctioned from the area through a suction port 62 of the distribution plate 60 travels through opening 54. A bottom plan view of the distribution plate 60 is shown in FIG. 18 and shows the suction port 62. Moreover, a plurality of dispensing opening 64 are arranged about the suction port 62. The cleansing fluid flowing onto the top side of the distribution plate 60 travels to one of the dispensing openings 64 and is dispensed therethrough onto the area being cleaned. It will be appreciated that flow through the area being cleaned, which area is at least partially sealed by the rim 19 of the applicator body 18, travels generally from the dispensing openings 64 arranged about the suction port 62 in a radial toward the suction port 62, as shown by the arrows in FIG. 19.

Figure 20:
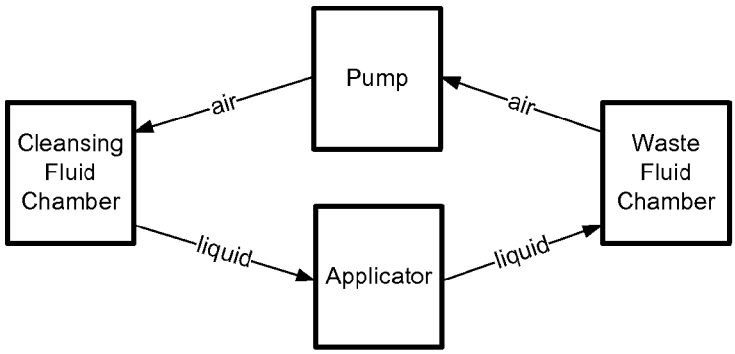
FIG. 20 is a schematic illustration of a flow system of a preferred cleaning apparatus for lifting, removing and extracting a spill or stain in accordance with one or more aspects and features of the present invention.

The general flow of the cleaning apparatus 10 is shown in FIG. 20. Specifically, air is pumped into the cleansing fluid chamber of the cleaning apparatus; cleansing fluid is thereby expelled from the cleansing fluid chamber to the applicator, where it is applied to the area being cleaned; waste fluid is suctioned from the area being cleaned into the waste fluid chamber; and air is drawn from the waste fluid chamber to the pump for delivery to the cleaning fluid chamber via the pump. It will be appreciated that the withdrawal of the air form the waste fluid chamber results in a low pressure that, in turn, results in the air flow and suctioning of the waste fluid from the applicator to the waster fluid chamber.

It will thus be appreciated that air is transferred through the pump from the waste fluid chamber to the cleansing fluid chamber as cleansing fluid is transferred through the applicator from the cleansing fluid chamber to the waste fluid chamber and waste fluid is transferred from the area being cleaned to the waste fluid chamber.

In use of the cleaning apparatus 10, the cleansing fluid chamber is filled with a cleansing fluid. Water may be used, or a solution including a solvent or other chemical may be used. The apparatus is next positioned over the area to be cleaned. While pressing the apparatus, the pump is manually actuated by moving the handle and piston up and down. This results in the flow represented in FIG. 20, wherein cleansing fluid is applied to the area and waste fluid is suctioned from the area. Additionally, the application of the cleansing fluid concurrently with the suctioning of the waste fluid is continuous since the pump is a dual action pump, driving the flow in both up and down strokes.

If the interior of the cleansing fluid chamber is visible from an exterior of the apparatus, the extent to which the cleansing fluid has been used can be monitored by a person using the apparatus. Once the cleansing fluid is exhausted, the cleaning process is stopped and the waste fluid is disposed of. If needed, the cleaning operation can be repeated once additional cleansing fluid has been added to the cleaning fluid chamber.

Figure 21:
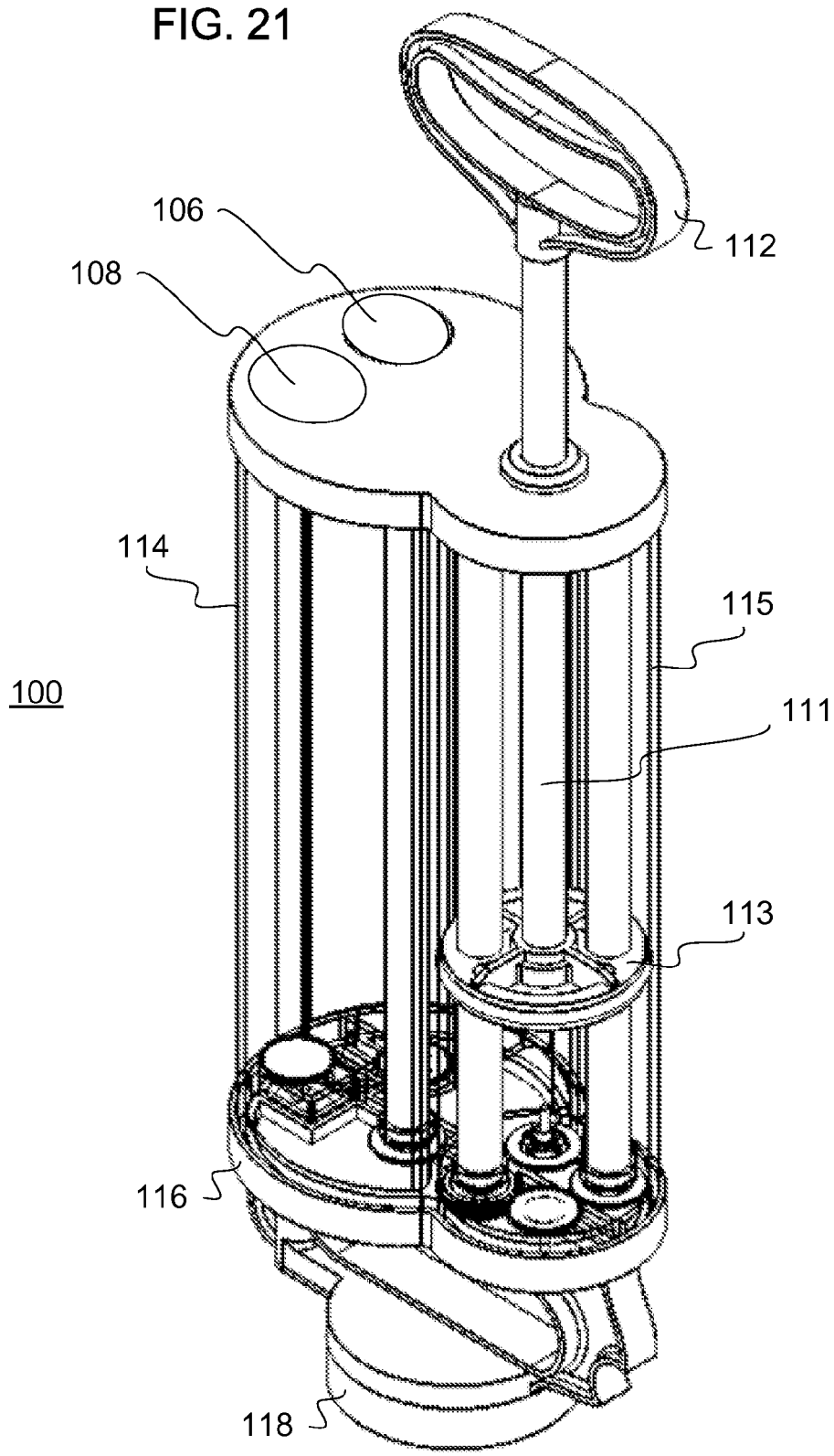
FIG. 21 is a perspective view of another preferred cleaning apparatus for lifting, removing and extracting a spill or stain in accordance with one or more aspects and features of the present invention.
Figure 22:
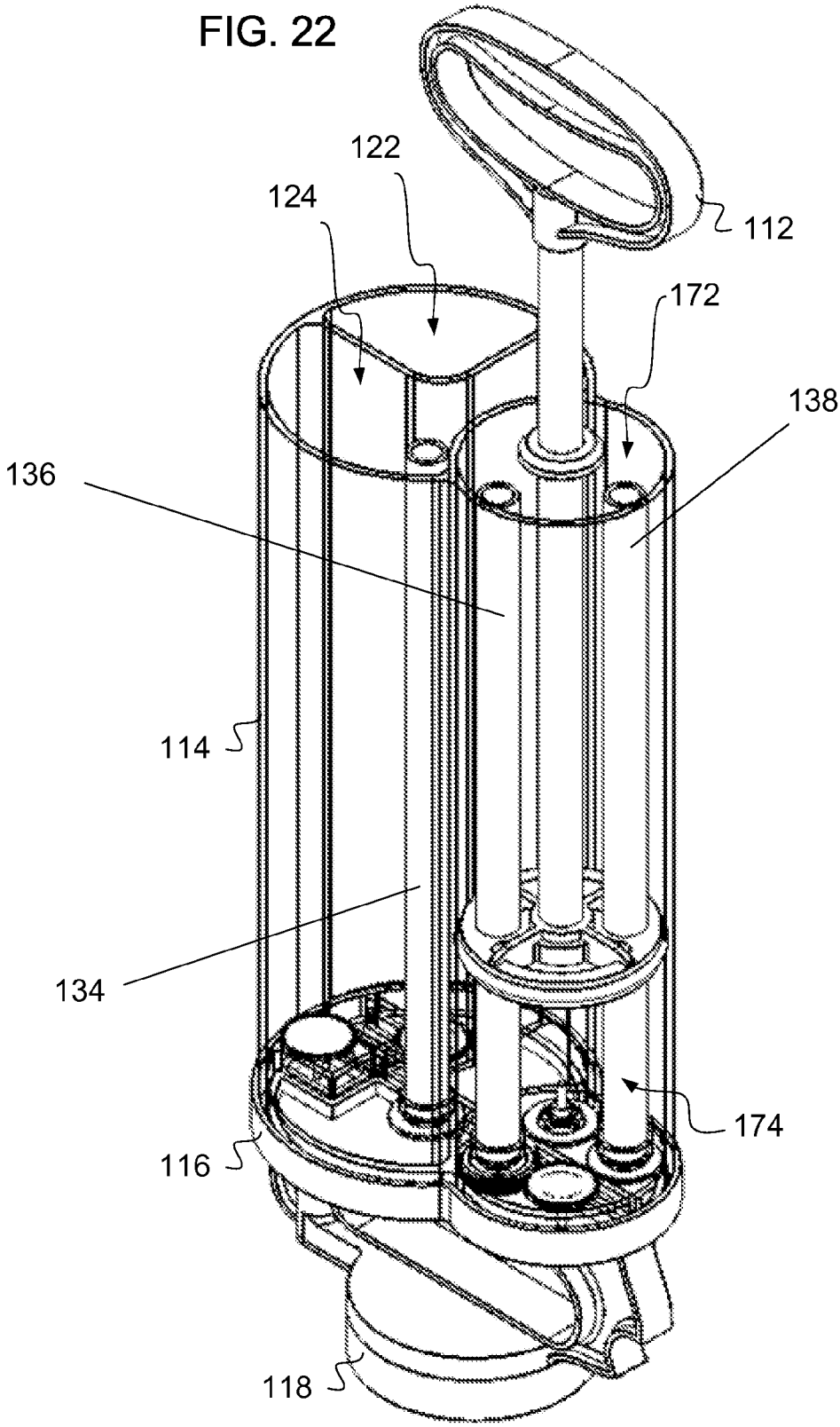
FIG. 22 is a similar view to that of FIG. 21, with the omission of some components in order to reveal the tops of the standing pipes and tops of the chambers and cylinder.
Figure 23:
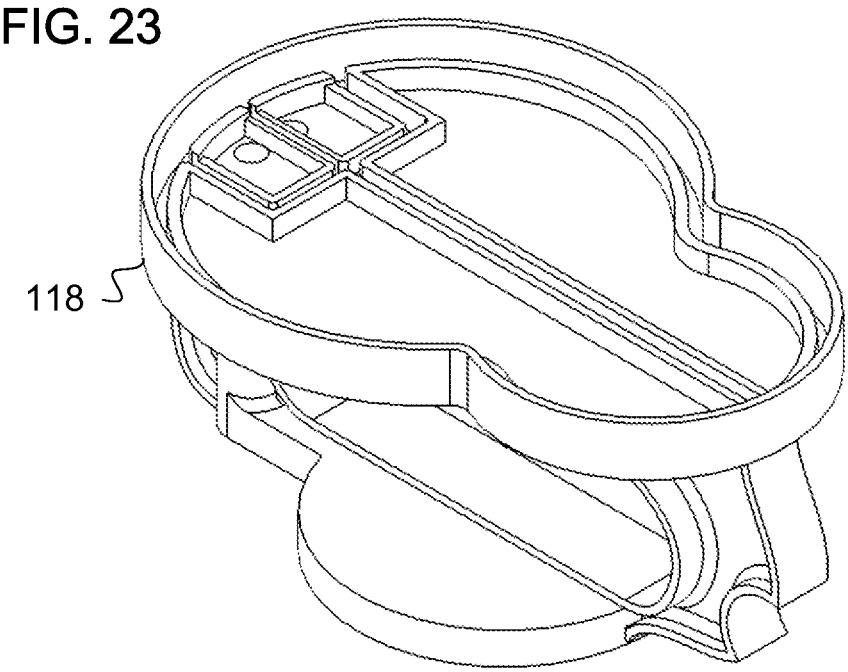
FIG. 23 is a perspective view including a top side of an applicator body of the apparatus of FIG. 21.
Figure 24:
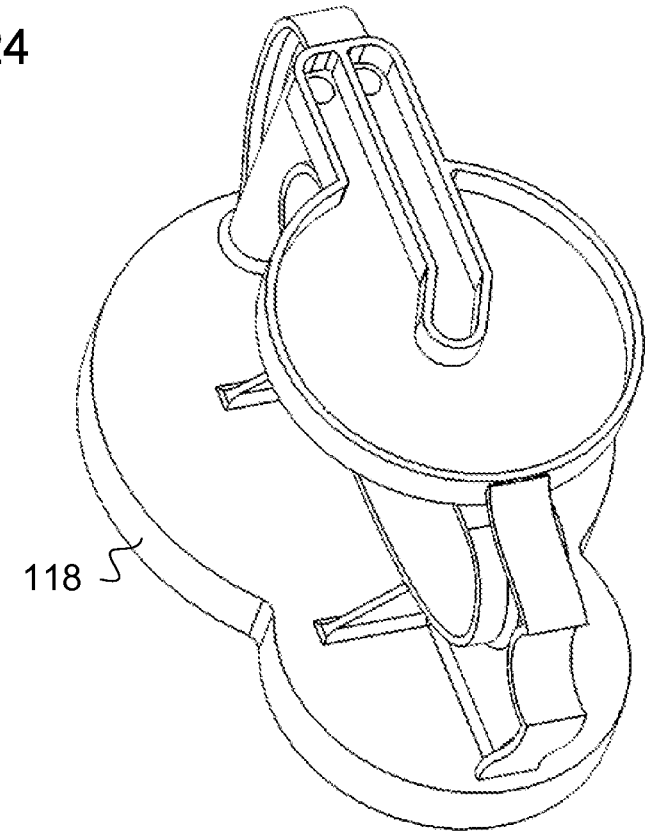
FIG. 24 is a perspective view including a bottom side of the applicator body of the apparatus of FIG. 21.
Figure 25:
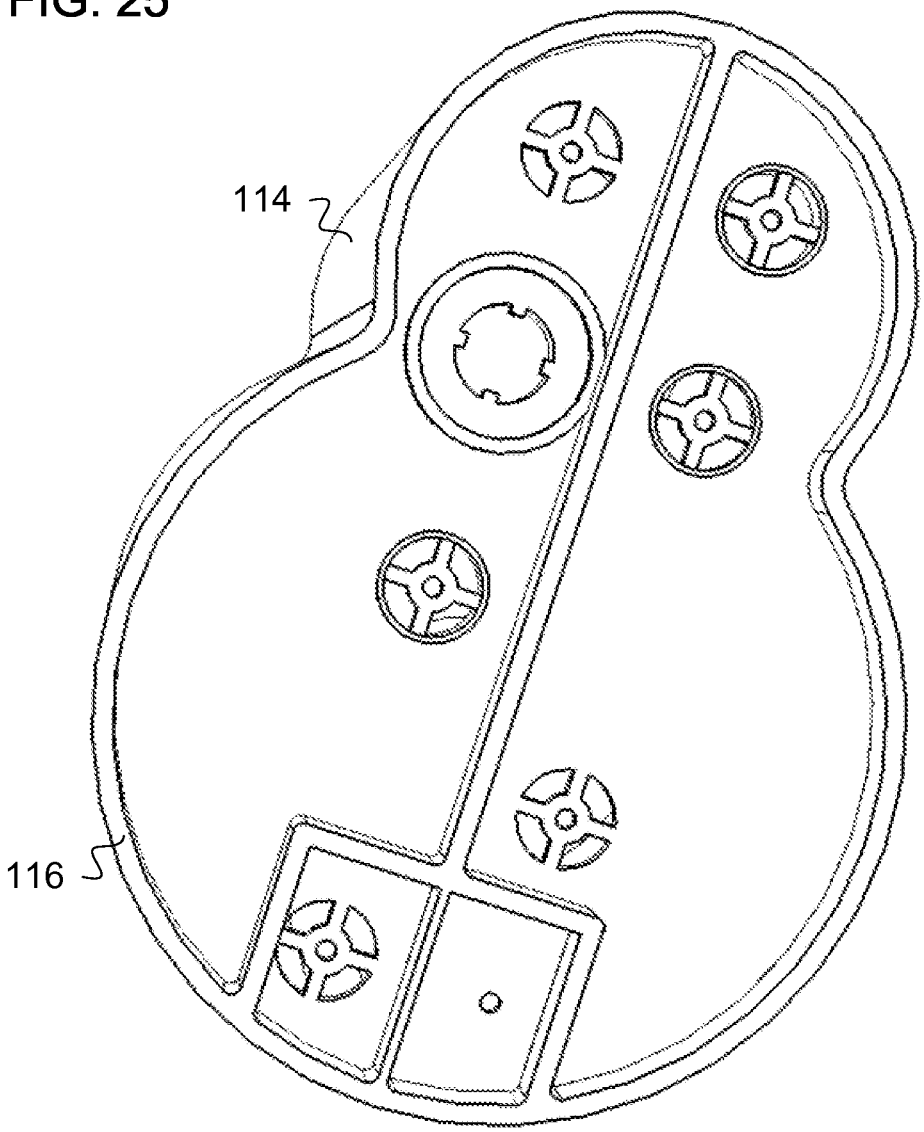
FIG. 25 is a perspective view including a bottom side of the container walls forming the chambers and cylinder of the apparatus of FIG. 21.

FIG. 21 is a perspective view of another preferred cleaning apparatus 100 for lifting, removing and extracting a spill or stain in accordance with one or more aspects and features of the present invention. FIG. 22 is a similar view to that of FIG. 21, with the omission of some components in order to reveal the tops of the standing pipes and tops of the chambers and cylinder. Additionally, FIG. 23 is a perspective view including a top side of an applicator body of the apparatus of FIG. 21; FIG. 24 is a perspective view including a bottom side of the applicator body of the apparatus of FIG. 21; and FIG. 25 is a perspective view including a bottom side of the container walls forming the chambers and cylinder of the apparatus of FIG. 21.

The apparatus 100 includes structure and operates in accordance with the same theory as apparatus 10 and 20 discussed above, and like those other embodiments, it includes a handle 112; outer wall 114; base 116; and applicator 118. The outer wall 114, together with an inner wall, define the cleansing fluid chamber 122 and waste fluid chamber 124. A cap covers 106 an opening to the cleansing fluid chamber 122; and a cap 108 covers an opening to the waste fluid chamber 124. In one difference, the cylinder 115 of the pump is disposed in part on the outside and is defined by both the inner and outer walls. The piston 111 and piston head 113 are located within the cylinder, as shown, and two standing pipes 136,138 are also included as before for flow to and from the first piston area 172. The second piston area 174 is located on the opposite side of the piston head 113, which seals off the two areas from each other.

Also, unlike the prior apparatus 10,20, the cleaning apparatus 100 includes only three standing pipes instead of five. The standing pipes for flow of the waste fluid into the waste fluid chamber 124, and flow of the air into the cleaning fluid chamber 122, may be omitted as shown. In alternatives, one or both of these omitted standing pipes are included.

As before, the movement of the piston 111 and piston head 113 within the cylinder 115 results in the pumping of air into the cleansing fluid chamber 122 regardless of the direction of movement of the piston 111 within the cylinder 115.

Yet additional embodiments of cleaning apparatus in accordance with one or more aspects of the present invention are disclosed in the incorporated Appendix.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A method of cleaning an area of flooring, comprising the steps of:

(a) providing an apparatus comprising:

(i) a pump, (ii) a cleansing fluid chamber, wherein a first fluid passageway connects the pump and the cleansing fluid chamber, (iii) an applicator, wherein a second fluid passageway connects the cleansing fluid chamber and the applicator, (iv) a waste fluid chamber, wherein a third fluid passageway connects the applicator and the waste fluid chamber and a fourth fluid passageway connects the waste fluid chamber and the pump, (v) a first one-way valve configured to permit flow through the first fluid passageway in a flow direction from the pump to the cleansing fluid chamber but inhibit flow through the first fluid passageway in a flow direction from the cleansing fluid chamber to the pump, (vi) a second one-way valve configured to permit flow through the third fluid passageway in a flow direction from the applicator to the waste fluid chamber but inhibit flow through the third fluid passageway in a flow direction from the waste fluid chamber to the applicator, and (vii) a base, wherein the first and fourth fluid passageways extend within the base, with the applicator being located to a first side of the base, and with the cleansing fluid chamber, the waste fluid chamber, and the pump each being located on a second side of the base opposite the first side;

(b) filling the cleansing fluid chamber of the cleaning apparatus with a cleansing fluid;

(c) positioning the apparatus over the area to be cleaned with the applicator covering the area of flooring to be cleaned, and with the cleansing fluid chamber, waste fluid chamber, and pump extending upwardly from the base away from the flooring; and (d) actuating the pump of the apparatus such that air from the waste fluid chamber of the cleaning apparatus is pumped into the cleansing fluid chamber of the cleaning apparatus and, commensurate therewith, suctioning waste fluid from the area of flooring while applying cleansing fluid from the cleansing fluid chamber to the area of flooring, the waste fluid suctioned from the area being received and retained within the waste fluid chamber of the apparatus.

2. The method of claim 1, further comprising gripping a handle of a piston by extending the fingers of a hand through an opening defined in the handle and actuating the pump by manually moving the piston UP and down relative to the base of the apparatus while keeping the base from moving relative to the flooring.

3. The method of claim 1, wherein the base of the cleaning apparatus is located proximate a bottom of the waste fluid chamber when the apparatus is positioned over the area of flooring to be cleaned; wherein the base of the cleaning apparatus is located proximate a bottom of the cleansing fluid chamber when the apparatus is positioned over the area of flooring to be cleaned; and wherein the base of the cleaning apparatus is located proximate a bottom of the pump when the apparatus is positioned over the area of flooring to be cleaned.

4. The method of claim 1, wherein, when the apparatus is positioned over the area of flooring to be cleaned, the first fluid passageway is defined, at least in part, by the interior passageway of a first pipe terminating within an upper area within the cleaning fluid chamber for flow of air up through the interior passageway of the first pipe into the cleaning fluid chamber.

5. The method of claim 4, wherein, when the apparatus is positioned over the area of flooring to be cleaned, the fourth fluid passageway is defined, at least in part, by the interior passageway of a second pipe having an end terminating within an upper area within the waste fluid chamber for flow of air from the waste fluid chamber down through the interior passageway of the second pipe.

6. The method of claim 5, wherein the first pipe is open-ended in the upper area of the cleaning fluid chamber, and wherein the second pipe is open-ended in the upper area of the waste fluid chamber.

7. A method of cleaning an area of flooring, comprising the steps of:

(a) providing a cleaning apparatus, the apparatus comprising:

(i) a pump, (ii) a cleansing fluid chamber, wherein a first fluid passageway connects the pump and the cleansing fluid chamber, (iii) an applicator, wherein a second fluid passageway connects the cleansing fluid chamber and the applicator, (iv) a waste fluid chamber, wherein a third fluid passageway connects the applicator and the waste fluid chamber and a fourth fluid passageway connects the waste fluid chamber and the pump, (v) a first one-way valve configured to permit flow through the first fluid passageway in a flow direction from the pump to the cleansing fluid chamber but inhibit flow through the first fluid passageway in a flow direction from the cleansing fluid chamber to the pump, (vi) a second one-way valve configured to permit flow through the third fluid passageway in a flow direction from the applicator to the waste fluid chamber but inhibit flow through the third fluid passageway in a flow direction from the waste fluid chamber to the applicator, and (vii) a base located proximate a bottom of the waste fluid chamber, a bottom of the cleansing fluid chamber, and a bottom of the pump, (viii) wherein the applicator defines a bottom of the apparatus, (ix) wherein the base extends between the applicator on a first side, and the cleansing fluid chamber, the waste fluid chamber, and the pump on a second side:

(x) wherein each of the cleansing fluid chamber, waste fluid chamber, and the pump extends from the base, and (xi) wherein the apparatus is hand portable and is configured to be positioned on top of the area of flooring to be cleaned with the applicator covering the area of flooring to be cleaned;

(b) filling the cleansing fluid chamber of the cleaning apparatus with a cleansing fluid;

(c) positioning the apparatus over the area to be cleaned with the applicator covering the area of flooring to be cleaned; and (d) actuating the pump of the apparatus such that air from the waste fluid chamber of the cleaning apparatus is pumped into the cleansing fluid chamber of the cleaning apparatus and, commensurate therewith, suctioning waste fluid from the area of flooring while applying cleansing fluid from the cleansing fluid chamber to the area of flooring, the waste fluid suctioned from the area being received and retained within the waste fluid chamber of the apparatus.

8. The method of claim 7, further comprising gripping a handle of a piston by extending the fingers of a hand through an opening defined in the handle and actuating the pump by manually moving the piston up and down relative to the base of the apparatus while keeping the base from moving relative to the flooring.

9. The method of claim 7, wherein the base of the cleaning apparatus is located proximate a bottom of the waste fluid chamber when the apparatus is positioned over the area of flooring to be cleaned; wherein the base of the cleaning apparatus is located proximate a bottom of the cleansing fluid chamber when the apparatus is positioned over the area of flooring to be cleaned; and wherein the base of the cleaning apparatus is located proximate a bottom of the pump when the apparatus is positioned over the area of flooring to be cleaned.

10. The method of claim 7, wherein, when the apparatus is positioned over the area of flooring to be cleaned, the first fluid passageway is defined, at least in part, by the interior passageway of a first pipe terminating within an upper area within the cleaning fluid chamber for flow of air up through the interior passageway of the first pipe into the cleaning fluid chamber.

11. The method of claim 10, wherein, when the apparatus is positioned over the area of flooring to be cleaned, the fourth fluid passageway is defined, at least in part, by the interior passageway of a second pipe having an end terminating within an upper area within the waste fluid chamber for flow of air from the waste fluid chamber down through the interior passageway of the second pipe.

12. The method of claim 11, wherein the first pipe is open-ended in the upper area of the cleaning fluid chamber, and wherein the second pipe is open-ended in the upper area of the waste fluid chamber.

13. A method of cleaning an area of flooring, comprising the steps of:

(a) providing a cleaning apparatus, the apparatus comprising:

(i) a pump, (ii) a cleansing fluid chamber, wherein a first fluid passageway connects the pump and the cleansing fluid chamber, (iii) an applicator, wherein a second fluid passageway connects the cleansing fluid chamber and the applicator, (iv) a waste fluid chamber, wherein a third fluid passageway connects the applicator and the waste fluid chamber and a fourth fluid passageway connects the waste fluid chamber and the pump, (v) a first one-way valve configured to permit flow through the first fluid passageway in a flow direction from the pump to the cleansing fluid chamber but inhibit flow through the first fluid passageway in a flow direction from the cleansing fluid chamber to the pump, (vi) a second one-way valve configured to permit flow through the third fluid passageway in a flow direction from the applicator to the waste fluid chamber but inhibit flow through the third fluid passageway in a flow direction from the waste fluid chamber to the applicator, and (vii) a base, with the applicator being located to a first side of the base, and with the cleansing fluid chamber, the waste fluid chamber, and the pump each being located on a second side of the base, (viii) wherein the apparatus is hand portable and is configured to be positioned on top of the area of flooring to be cleaned with the applicator covering the area of flooring to be cleaned, (ix) wherein the first fluid passageway is defined, at least in part, by the interior passageway of a first pipe that, when the apparatus is positioned on top of the area of flooring to be cleaned, extends from the base and terminates within an upper area within the cleaning fluid chamber for flow of air up through the interior passageway of the first pipe into the cleaning fluid chamber, and (x) wherein the fourth fluid passageway is defined, at least in part, by the interior passageway of a second pipe that, when the apparatus is positioned on top of the area of flooring to be cleaned, extends from the base and terminates within an upper area within the waste fluid chamber for flow of air from the waste fluid chamber down through the interior passageway of the second pipe;

(b) filling the cleansing fluid chamber of the cleaning apparatus with a cleansing fluid;

(c) positioning the apparatus over the area to be cleaned with the applicator covering the area of flooring to be cleaned; and (d) actuating the pump of the apparatus such that air from the waste fluid chamber of the cleaning apparatus is pumped into the cleansing fluid chamber of the cleaning apparatus and, commensurate therewith, suctioning waste fluid from the area of flooring while applying cleansing fluid from the cleansing fluid chamber to the area of flooring, the waste fluid suctioned from the area being received and retained within the waste fluid chamber of the apparatus.

14. The method of claim 13, further comprising gripping a handle of a piston by extending the fingers of a hand through an opening defined in the handle and actuating the pump by manually moving the piston up and down relative to the base of the apparatus while keeping the base from moving relative to the flooring.

15. The method of claim 13, wherein the base of the cleaning apparatus is located proximate a bottom of the waste fluid chamber when the apparatus is positioned over the area of flooring to be cleaned; wherein the base of the cleaning apparatus is located proximate a bottom of the cleansing fluid chamber when the apparatus is positioned over the area of flooring to be cleaned; and wherein the base of the cleaning apparatus is located proximate a bottom of the pump when the apparatus is positioned over the area of flooring to be cleaned.

16. The method of claim 13, wherein, when the apparatus is positioned over the area of flooring to be cleaned, the first fluid passageway is defined, at least in part, by the interior passageway of a first pipe terminating within an upper area within the cleaning fluid chamber for flow of air up through the interior passageway of the first pipe into the cleaning fluid chamber.

17. The method of claim 16, wherein, when the apparatus is positioned over the area of flooring to be cleaned, the fourth fluid passageway is defined, at least in part, by the interior passageway of a second pipe having an end terminating within an upper area within the waste fluid chamber for flow of air from the waste fluid chamber down through the interior passageway of the second pipe.

18. The method of claim 17, wherein the first pipe is open-ended in the upper area of the cleaning fluid chamber, and wherein the second pipe is open-ended in the upper area of the waste fluid chamber.

19. The method of claim 13, further comprising pressing the cleaning apparatus against the flooring such that at least a partial seal is created by applicator in its abutment with the flooring.

20. The method of claim 14, further comprising keeping the base from moving relative to the flooring by pressing downward on one of the cleaning fluid chamber and the waste fluid chamber while actuating the pump.

* * * * *